United States Patent [19]

Yamao

[11] 4,237,655

[45] Dec. 9, 1980

[54] SLIDING DOOR

[76] Inventor: Chishiro Yamao, 29-13, Shiroyama-machi, Nagasaki-shi, Nagasaki-ken, Japan

[21] Appl. No.: 923,434

[22] Filed: Jul. 10, 1978

[30] Foreign Application Priority Data

Feb. 20, 1978 [JP] Japan ..... 53-22055[U]

[51] Int. Cl.[3] ..... E05D 15/30

[52] U.S. Cl. ..... 49/252; 49/360

[58] Field of Search ..... 49/252, 253, 250, 260, 49/261, 208, 360

[56] References Cited

U.S. PATENT DOCUMENTS

| | | | |
|---|---|---|---|
| 2,019,526 | 11/1935 | Ellison | 49/252 |
| 2,555,859 | 6/1951 | Rappl et al. | 49/352 |
| 2,905,464 | 9/1959 | Shaw, Sr. | 49/252 |
| 3,137,491 | 6/1964 | Coenen | 49/360 X |
| 3,456,388 | 7/1969 | Hanson et al. | 49/252 |
| 3,468,061 | 9/1969 | Ozaki | 49/360 |
| 3,483,657 | 12/1969 | Fraioli | 49/252 |

*Primary Examiner*—Philip C. Kannan

*Attorney, Agent, or Firm*—Jordan and Hamburg

[57] ABSTRACT

The sliding door of this invention substantially comprises a door body and a mechanism which imparts the slide movement and rotating movement to the door body simultaneously. Due to such mechanism, the sliding door can be opened or closed necessitating the considerably smaller operating space compared with conventional slide doors or swinging doors. Such door provides full utilization of the space of a building such as a warehouse.

9 Claims, 5 Drawing Figures

SLIDING DOOR

BACKGROUND OF THE INVENTION

This invention relates to a sliding door which can be opened or closed with a minimum space for operation.

Conventional doors can substantially be classified into (a) a sliding door which slides along a groove, (b) a swinging door which swings on pivots or hinges, and (c) a folding door which folds like an accordion. However, such conventional doors have required a considerably large space for either their opening or closing operation.

Namely, the sliding door necessitates a door case of a considerable size for accommodating such door. The swinging door may be pushed either way occupying a semi-circular operating space. Such space is referred to as "the dead space" which implies a space which cannot be used for any other purposes but for the movement of the door. The dead space generally provides an inconvenience to any type of house and particularly to a warehouse which has a narrow frontage. Although the folding door requires the smaller operating space compared to those of the above-mentioned sliding door or swinging doors, such a door must necessitate a plurality of door boards which are pivotally connected with each other to impart flexibility to the door. Thereby, the sliding door is weak in structure and also gives a poor aesthetic appearance.

It is an object of the present invention to provide an improved type of sliding door which requires a minimum of "dead space" thereby enabling full or maximum utilization of the space of any house or building.

It is another object of the present invention to provide an improved type of sliding door which can be automatically opened or closed.

It is a further object of the present invention to provide an improved type of sliding door which is of a single construction and thereby can be readily manufactured.

BRIEF DESCRIPTION OF THE DISCLOSURE

DETAILED DESCRIPTION OF THE DISCLOSURE

Figure 1:
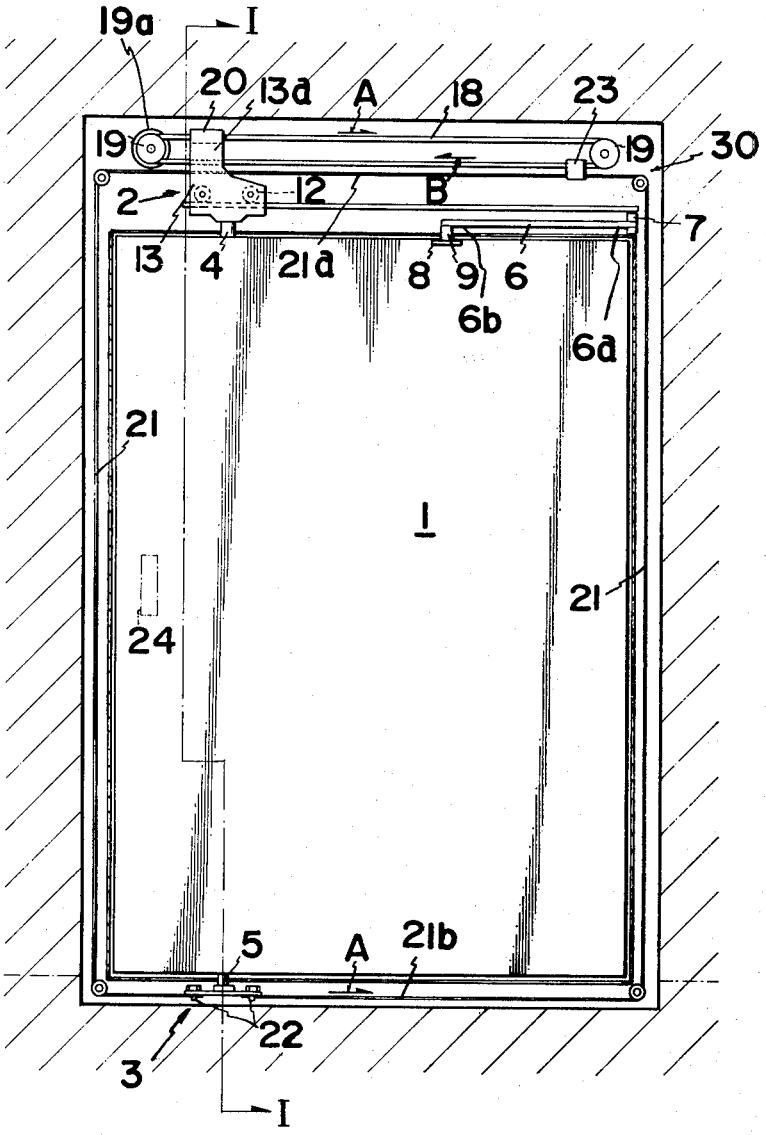
FIG. 1 is a front view of the sliding door of the present invention.

In FIG. 1, a door body 1 is shown enclosed by a door casing 30 which in turn is embedded in a surrounding wall. Above and below the door body 1, upper and lower door guide structures 2 and 3 are provided parallel to the top and bottom brim of the door body 1. Such guide structures 2, 3 are secured to the surface of the door casing 30 and engage with the upper and lower guide pins 4, 5 which abut to the upper and lower brim of the door body 1 respectively. These guide pins 4 and 5 are arranged in vertical alignment with each other. A pivoting lever 6 is provided adjacent to one lateral side of the door body 1 wherein the lever 6 is substantially parallely spaced from the surface of the door body 1. The lever 6 has the proximal end **6*a* thereof pivotally attached to a fulcrum point 7 on the door casing 30 adjacent to the above lateral side of the door body 1 and the distal end 6*b* pivotally attached to an intermediate pivoting point 9 on a lug portion 8 of the door body 1 which is disposed between the guide pin 4 and the fulcrum point 7**.

The lug portion 8 is provided by securing a bracket to the upper brim of the door body 1 in place. An imaginary triangular shape which can vary the shape thereof is formed by connecting the guide pin 4, the fulcrum point 7 and the intermediate pivoting point 9.

In the above construction, the upper door guide structure 2 comprises an upper portion 10 of the door casing 30, a guide rail 11 of a [-shaped cross section secured to the above upper portion 10, a pair of guide rollers 12 which rotate on a tread portion **11*a* of the guide rail 11 and a suspending plate 13 which has the upper portion pivotally connected with the guide rollers 12 and the lower portion rotatably connected with the guide pin 4 of the door body 1. The lower door guide structure 3 substantially comprises a bottom portion 14 of the door casing 30 which has a []-shaped cross section and a sliding plate 16 which is slidable within and along the bottom portion 14 by way of auxiliary rollers 15. The guide shaft 5 is rotatably mounted on the sliding plate 16**.

The sliding door of this invention is further provided with an automatic drive mechanism which can automatically open or close the sliding door.

Referring to such drive mechanism, an endless V belt 18 is wound around spaced-apart pulleys 19 rotatably mounted on the upper portion 10 of the door casing 30. An extension **13*a* of the suspending plate 13 is fastened to the upper line of the endless belt 18 in place by means of a fastening means 20. A pulling-force transmitting line 21 is disposed over the door casing 30 surrounding the periphery of the door body 1. The transmitting line 21 has the upper horizontal portion 21*a* disposed parallely to the lower line of the endless belt 18. The upper horizontal portion of the transmitting line 21 is connected with the lower line of the endless belt 18 by a fastening means 23. The transmitting line 21 has the lower horizontal portion 21*b* secured to the slide plate 16 by a fastening means 22. A power operated motor 19*a* is operably connected with either one of the pulleys 19**.

If desired, the sliding door of this invention can be operated manually instead of automatically. For that purpose, a knob 24 may be provided on the door body 1.

The manner in which the sliding door of the present invention is operated is hereinafter disclosed.

Figure 2:
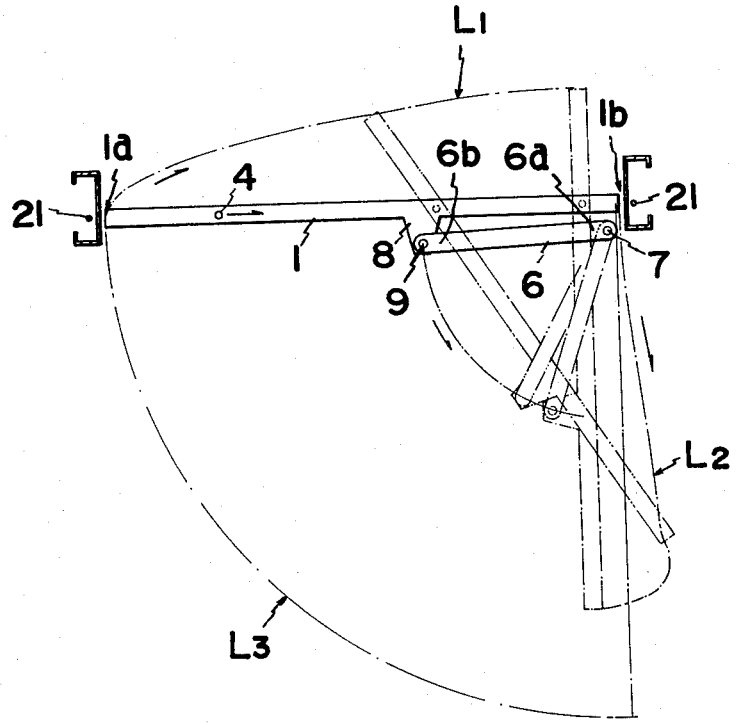
FIG. 2 is a transverse explanatory view of the above sliding door showing the mode of operation of the sliding door.
Figure 3:
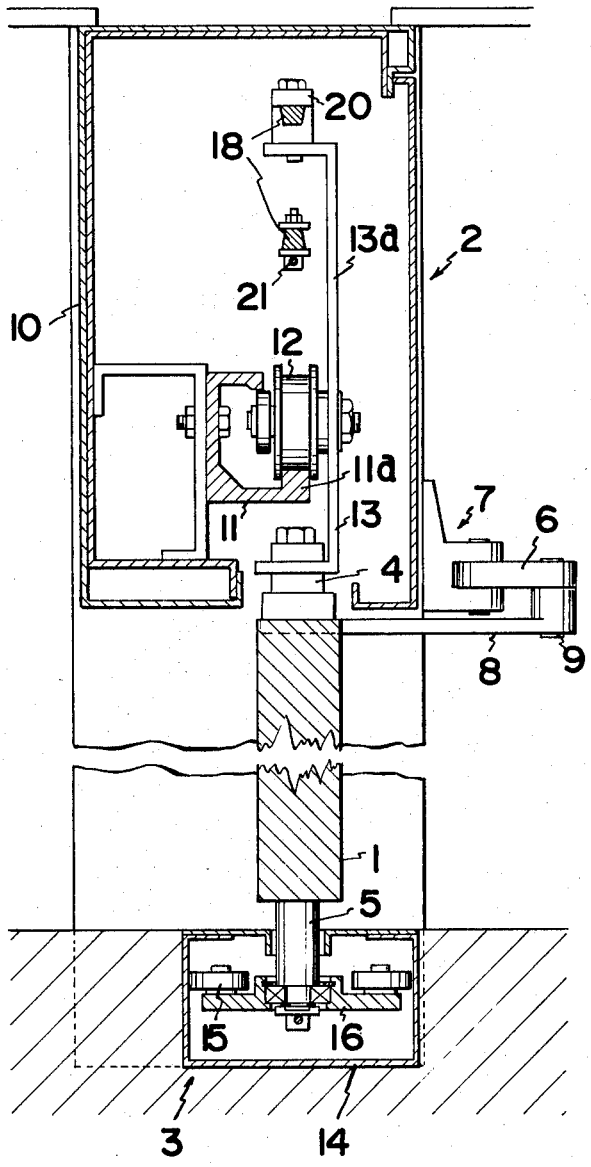
FIG. 3 is an enlarged partial longitudinal cross-sectional view of the above sliding door taken along line I—I of FIG. 1.

Along with the actuation of the power-operated motor **19*a*, the endless V belt 18 rotates in direction A. The rotation of the belt 18 incurs the movement of the suspending plate 13 in direction A and accordingly the guide pin 4 also moves in direction A. Simultaneously along with the rotation of the V belt 18, the pulling-force transmitting line 21 connected with the lower side of the V belt 18 rotates in direction B around the door body 1. Such rotation of the transmitting line 21 incurs the movement of the sliding plate 16 and the guide pin 5 in direction A. Corresponding to the movement of the pins 4 and 5 in direction A, the rotary lever 6 which has the proximal end thereof mounted on the lateral side of th 21 connected with the lower side of the V belt 18 rotates in direction B around the door body 1. Such rotation of the transmitting line 21 incurs the movement of the sliding plate 16 and the guide pin 5 in direction A. Corresponding to the movement of the pins 4 and 5 in direction A, the rotary lever 6 which has the proximal end thereof mounted on the lateral side of the door casing 30 rotates on the fulcrum point 7 as shown in FIG. 2. Due to the restricted movement of the guide pins 4, 5 and the rotary lever 6, the sliding door moves as shown in FIG. 2 and eventually takes a full-open position which is perpendicular to a full-close position. In the above movement of the sliding door, the front and the rear ends 1***a*, 1*b* take the loci $L_1$ and $L_2$ also shown in FIG. 2. FIG. 2 also shows a locus $L_3$ drawn by the conventional swinging door. Therefore, such sliding door necessitates the minimum operating space. The operation to close the door is imparted by the actuation of the power-operated motor in a reverse direction.

Figure 4:
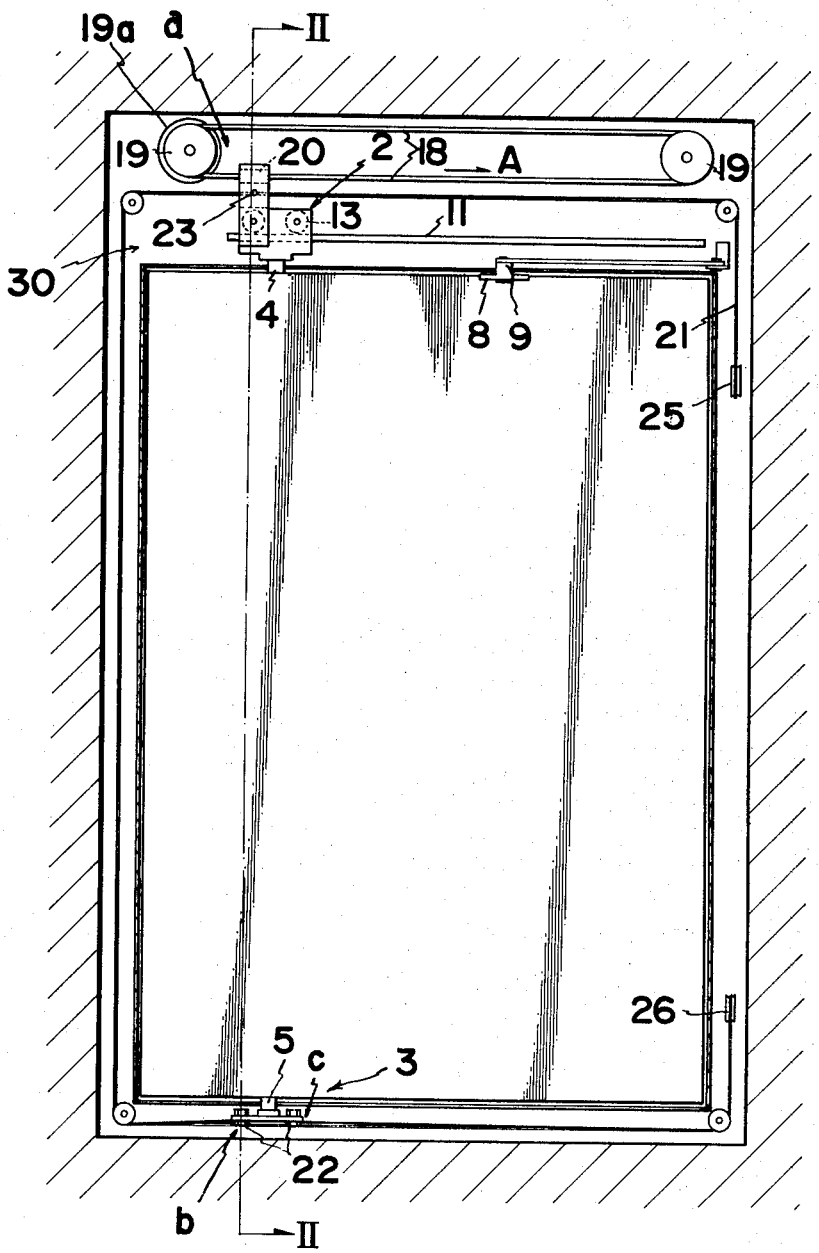
FIG. 4 is a front view of a modification of the sliding door of the present invention.
Figure 5:
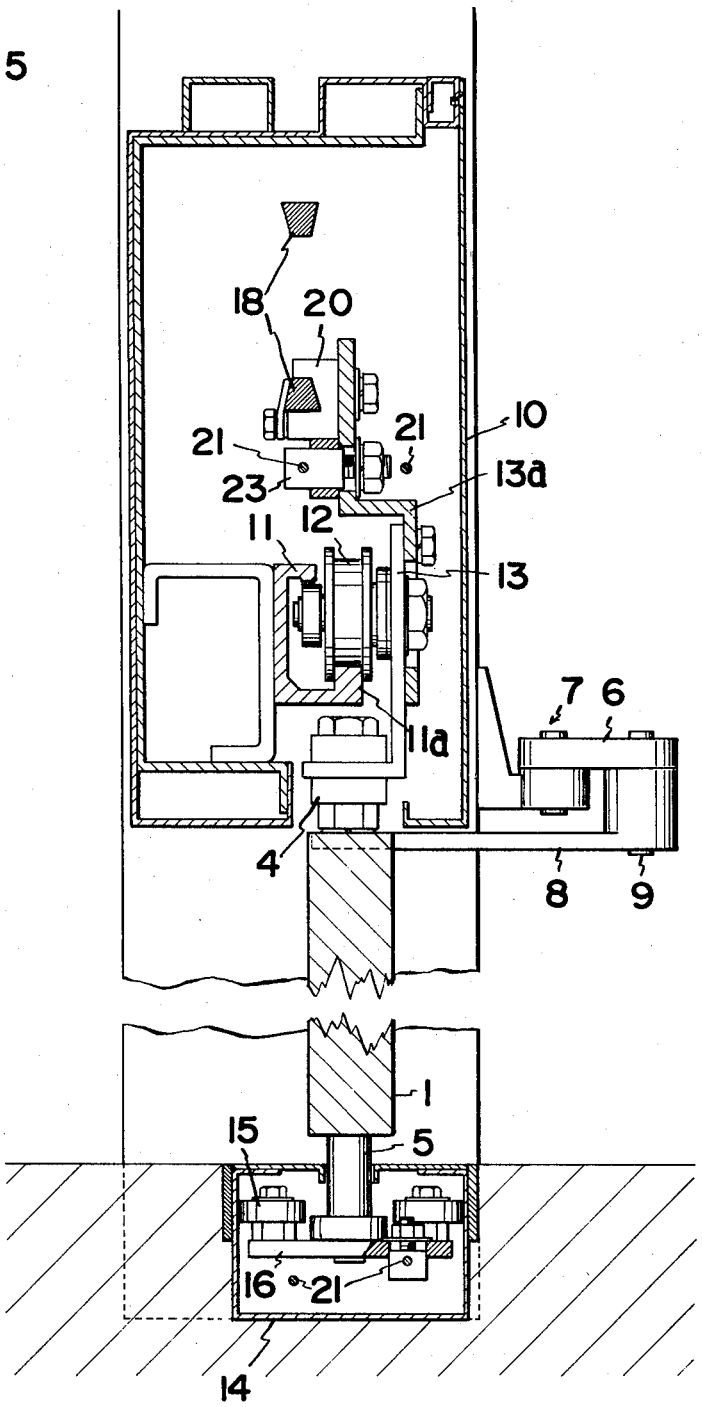
FIG. 5 is an enlarged partial longitudinal cross-sectional view of the above sliding door taken along the line II—II of FIG. 4.

A modification of the sliding door of this invention is shown in FIG. 4 and FIG. 5.

In this modification, the suspending plate 13 and the pulling-force transmitting line 21 are both fastened to the under side of the V belt 18. Furthermore, the transmitting line 22 does not form a round loop around the periphery of the sliding door. Instead, the transmitting line 21 forms a [-shaped loop around the door body 1. To be more specific, the line 21 which has a suitable portion thereof secured to the under side of the V belt 18 is first wound around an upper pulley 25 mounted on one lateral side of the door casing 30. After being wound around the pulley 25, the line 21 returns toward and passes the fastening position 23 and then terminates at one end b of the sliding plate 16. Subsequently, starting from the other end c of the sliding plate 16, the transmitting line 22 is wound around a lower pulley 26 mounted on the above-mentioned lateral side of the door casing 30. After being wound around the pulley 26 the line 21 returns toward and passes the lower fastening positions c and b and finally completes the loop by returning to the fastening position 23.

Due to the above construction, the actuation of the power-operated motor 19*a* incurs a more accurate and sumultaneous movement of the guide pins 4 and 5 thereby the smooth sliding movement of the sliding door is further enhanced. Furthermore, even if the pulling-force transmitting line 21 is slackened by a chance, the line 21 can be readily tightened by merely shifting the position of either the upper pulley 25 or lower pulley 26.

As has been described heretofore, the sliding door of the present invention has the following advantages.

(1) Since the operating space which the sliding door requires in either the opening or closing operation can be considerably decreased compared to the operating spaces of conventional doors, the space of a building can be fully utilized.

(2) Since the door is made of a single board and can take a perpendicular position when opened, the door can have and maintain an aesthetic appearance.

What we claim is:

1. A sliding door comprising:

(1) a vertical door body having a rectangular shape, (2) a door casing surrounding said vertical door body, said door casing comprising first and second vertical side members and upper and lower horizontal members, (3) upper and lower guide structures for guiding the movement of said door body, said guide structures being mounted on said upper and lower horizontal members of said door casing, (4) upper and lower connecting means for rotatably and slidably connecting the upper and lower brims of said door body to said upper and lower guide structures respectively, said upper connecting means comprising an upper pivot pin which is secured to the upper brim of said door body and carried by a suspension plate which is slidably received in said upper guide structure, said lower connecting means comprising a lower pivot pin which is secured to the lower brim in said door body and carried by a sliding plate which is slidably received in said lower guide structure, and (5) a rotary elongated lever disposed above and parallel to the surface of the upper brim of said door body, said rotary lever having a proximal end thereof pivotally mounted on a lateral pivot shaft secured to said first vertical side member of said door casing and a distal end pivotally connected to an upright lug secured to an intermediate position of said upper brim of said door body, said lateral pivot shaft also being disposed above said upper brim of said door casing, whereby upon the exertion of an initial pulling force on said closed door body exclusively in a direction parallel to said upper guide structure, said sliding door slides along said guide structures and simultaneously rotates on said upper and lower pivot pins to move to a full open position which is perpendicular to the original closed position, said upper pivot pin, said intermediate upright lug, and said lateral pivot shaft defining an imaginary triangular configuration, said upper pivot pin, said intermediate upright lug, and said lateral pin being disposed above the upper brim of said door body such that said door body can cross underneath said rotary elongated lever without being obstructed by said rotary elongated lever when said door body is moved between closed and open positions.

2. A sliding door according to claim 5, further comprising a drive mechanism for automatically opening and closing said door body, said automatic drive mechanism being mounted on said upper longitudinal member.

3. A sliding door according to claim 6, wherein said automatic drive mechanism comprises:

(1) a horizontal endless belt extending between and wound around two pulleys which are disposed at a distance which substantially corresponds to the width of said door body, said belt being mounted on the upper portion of said door casing in a parallel and spaced-apart relationship relative to said upper guide structure, said endless belt comprising an upper horizontal run and a lower horizontal run which are disposed parallel to each other, (2) a power operated motor for driving one of said two pulleys, (3) a first fastening means connecting said upper connecting means to said upper horizontal run of said endless belt such that the slide movement of said upper horizontal run of said endless belt causes the simultaneous slide movement of said upper connecting means in the same direction, (4) an endless pulling-force transmitting line surrounding said door body, said transmitting line consisting of upper and lower horizontal line sections and vertical first and second side line sections, (5) a second fastening means rotatably connecting said lower connecting means to said lower horizontal line section of said transmitting line, and (6) a third fastening means securing said upper horizontal line section of said transmitting line to said lower horizontal run of said endless belt, whereby the pulling force exerted by said power operated motor is transferred to said upper and lower connecting means by means of said endless belt and said pulling-force transmitting line.

4. A sliding door according to claim 6, wherein said automatic drive mechanism comprises:

(1) a horizontal endless belt extending between and wound around two pulleys which are disposed at a distance which substantially corresponds to the width of said door body, said belt being mounted on the upper portion of said door casing in a parallel and spaced-apart relationship relative to said upper guide structure, said endless belt comprising upper and lower horizontal runs which are disposed parallel to each other, (2) a power operated motor for driving one of said two pulleys, (3) a first fastening means rotatably connecting said upper connecting means to said lower horizontal run of said endless belt such that the slide movement of said lower horizontal run of said endless belt causes the simultaneous slide movement of said upper connecting means in the same direction, (4) an endless pulling-force transmitting line disposed at least partially around said door body, said transmitting line consisting of a first horizontal going section disposed adjacent the upper horizontal member of said door casing and passing over an upper pulley disposed at the upper portion of said door casing, a vertical going section having one end connected with the extending end of said first horizontal going section and the other end vertically extending toward one lower corner of said door casing, a second horizontal going section disposed adjacent the lower horizontal member of said door casing and having one end connected with the extending end of said vertical going section and the other end passing around a lower pulley disposed at the lower portion of said door casing, a third lower horizontal return section disposed in alignment with said second horizontal going section and extending from said lower pulley in a direction opposite to said second horizontal going section, a vertical return section disposed in alignment with said vertical going section and having its proximal end connected with the extending end of said third lower horizontal return section and extending vertically toward an upper corner of said door casing, and a fourth horizontal return section disposed in alignment with said first horizontal going section and having its proximal end connected with the extending end of said vertical return section and having the extending end thereof connected with the distal end of said first horizontal going section, (5) a second fastening means securing said first horizontal going section of said pulling-force transmitting line to said first fastening means, and (6) a third fastening means connecting said lower connecting means to said third lower horizontal section of said pulling-force transmitting line, whereby the pulling-force exerted by said power-operated motor is transferred to said upper and lower connecting means by way of said endless belt and said pulling force transmitting line.

5. A sliding door according to claim 6 wherein said automatic drive mechanism comprises a power-driven endless belt mounted on the upper portion of said door casing, said endless belt having upper and lower runs, first fastening means rotatably connecting said upper connecting means to one of said runs, an endless pulling-force transmitting line disposed about at least sections of said door body, a second fastening means rotatably connecting said lower connecting means to said transmitting line, and a third fastening means connecting said transmitting line to said endless belt such that the pulling force exerted by the power-driven endless belt is transmitted to said upper and lower connecting means through said endless belt and said transmitting line.

6. A sliding door according to claim 1 wherein said first and second pivot pins are slidable generally in a first plane parallel to the door body when the latter is in said closed position, said upright lug extending laterally relative to one flat side of the door body to define a first vertical pivotal axis spaced from said first plane when said door is in its closed position, said lateral pivot shaft being pivotable about a second vertical axis laterally spaced from said first plane, said first axis being spaced from said first plane a distance which differs from the distance that said second axis is spaced from said first plane for all positions of said door body including the closed position, whereby said imaginary triangle configuration is maintained for all positions of the door including the closed position.

7. A sliding door according to claim 6 wherein said first axis is spaced further from said first plane than said second axis.

8. A sliding door comprising a door body, a door casing surrounding said door body, upper and lower connecting means for rotatably and slidably connecting said upper and lower ends of said door body to said door casing, said upper connecting means comprising an upper pivot pin which is secured to the upper end of said door body carried by a suspension plate and which is slidably mounted relative to said door casing, said lower connecting means comprising a lower pin which is secured to the lower end of said door body carried by a sliding plate and which is slidably mounted relative to said door casing, said upper and lower connecting means being slidable generally in a first plane as the door body is moved to open and closed positions, said door body being disposed in said first plane when said door body is in its closed position and being perpendicular to said first plane when said door body is in said closed position, an upright lug extending laterally relative to one flat side of the door body to define a first pivotal axis spaced from said first plane when said door body is in its closed position, a lateral pivot shaft mounted on said door casing and being pivotable about a second axis laterally spaced from said first plane, an elongated lever disposed above the upper edge of said door body, said lever being pivobably connected to said upright lug and to said lateral pivot shaft, said upper pivot pin, said upright lug and said lateral pivot shaft being disposed above the upper edge of said door body such that said door body can pass underneath said lever without being obstructed by the lever when said door body is moved between closed and open positions, said first pivotal axis being spaced from said first plane a distance which differs from the distance that said second axis is spaced from said first plane for all positions of said door including the closed position such that the axis of said upper pin, said first pivotal axis, and said second axis define an imaginary triangle, whereby exertion of an initial pulling force on said closed door body exclusively in the direction parallel to the general plane of the door body when the door is in a closed position results in a sliding and simultaneously rotation of said door body on said connecting means as the door body moves to a closed position perpendicular to the original open position.

9. A sliding door according to claim 8 wherein said first axis is spaced further from said first plane than said second axis.

* * * * *